US011306549B2

(12) United States Patent
McCabe et al.

(10) Patent No.: US 11,306,549 B2
(45) Date of Patent: Apr. 19, 2022

(54) HANDLING TOOL FOR CASING TONGS

(71) Applicant: Cameron International Corporation, Houston, TX (US)

(72) Inventors: Kenneth McCabe, Kristiansand (NO); Dag Holen, Kristiansand (NO); Lars Petter Smeland, Kristiansand (NO); Glenn Saebo, Kristiansand (NO); Svein Jarle Haugland, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 226 days.

(21) Appl. No.: 16/334,728

(22) PCT Filed: Sep. 29, 2017

(86) PCT No.: PCT/US2017/054261

§ 371 (c)(1),
(2) Date: Mar. 19, 2019

(87) PCT Pub. No.: WO2018/064457

PCT Pub. Date: Apr. 5, 2018

(65) Prior Publication Data

US 2019/0271199 A1 Sep. 5, 2019

Related U.S. Application Data

(60) Provisional application No. 62/402,542, filed on Sep. 30, 2016.

(51) Int. Cl.
*E21B 19/14* (2006.01)
*E21B 19/02* (2006.01)
(Continued)

(52) U.S. Cl.
CPC ..... *E21B 19/14* (2013.01); *E21B 19/02* (2013.01); *E21B 19/165* (2013.01); *B66D 3/02* (2013.01)

(58) Field of Classification Search
CPC ..... E21B 19/14; E21B 19/02; E21B 19/165; B66D 3/02
See application file for complete search history.

(56) References Cited

U.S. PATENT DOCUMENTS 4,696,207 A * 9/1987 Boyadjieff ..... E21B 19/20 211/60.1
6,318,214 B1 11/2001 Buck
(Continued)

OTHER PUBLICATIONS

International Preliminary Report on Patentability ion for the equivalent International patent application PCT/US2017/054261 dated Apr. 11, 2019.
(Continued)

*Primary Examiner* — George S Gray
(74) *Attorney, Agent, or Firm* — Kelly McKinney

(57) ABSTRACT

Embodiments of a vertical pipe handler system (50) and method of its use include a casing tong handling tool (10) connected to a lifting tool (55) having a gripper head (51) and supported by an arm (53) of the vertical pipe handler system. The casing tong connection (33) of the handling tool is located toward the tool's lower end (21) and may be offset in a horizontal direction from the connection (29) to the lifting tool. The casing tong (60) then hangs off-center relative to the lifting tool. The amount of offset may be effective to prevent interference between the gripper head and a tubular being handled by the casing tong.

16 Claims, 2 Drawing Sheets

(51) Int. Cl.
*E21B 19/16* (2006.01)
*B66D 3/02* (2006.01)

(56) References Cited

U.S. PATENT DOCUMENTS

| | | | | |
|---|---|---|---|---|
| 2008/0245575 | A1* | 10/2008 | Guidry | E21B 19/087 175/85 |
| 2009/0255681 | A1 | 10/2009 | Spencer | |
| 2013/0008644 | A1* | 1/2013 | Huseman | E21B 19/20 166/250.01 |
| 2014/0224470 | A1 | 8/2014 | Bouligny et al. | |
| 2016/0115748 | A1 | 4/2016 | Ottersland | |

OTHER PUBLICATIONS

International Search Report and Written Opinion for the equivalent International patent application PCT/US2017/054261 dated Feb. 13, 2018.

* cited by examiner

HANDLING TOOL FOR CASING TONGS

CROSS REFERENCE PARAGRAPH

This application claims the benefit of U.S. Provisional Application No. 62/402,542, entitled "HANDLE TOOL FOR CASING TONGS," filed Sep. 30, 2016, the disclosure of which is hereby incorporated herein by reference.

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates to pipe handling equipment used on various drilling rigs, like jackup rigs, semisubmersible rigs, drill ships, or land rigs, and, in particular, to equipment used to perform vertical drilling tubular handling operations on the drill floor.

Drilling tubulars include drill pipe, tubing, and casing ("tubulars") which are assembled by threading one section of tubular to the next. Management of tubulars on the drill floor is conducted by various vertical pipe handling components and features that retrieve tubular, position the tubular into the mousehole, and tighten one tubular to the next.

One of these handling components is the casing tong. Prior art handling of the casing tong is done by way of a separate arm that moves the casing tong, combined with time-consuming manual handling. This prior art approach limits accessible space on the drill floor and can present safety risks to workers. Therefore, a need exists to handle tubulars in less space than the prior art approaches, with less material and manual handling, and with improved levels of safety.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

Embodiments of vertical pipe handling system including a handling tool for casing tongs that eliminates the need for a separate, dedicated arm to handle the casing tongs. The handling tool is mounted in a tubular lifting tool of a vertical pipe handler. The lifting tool includes a gripper head. The handling tool includes a casing tong connection that may be offset from the handling tool's connection to the lifting tool. This offset allows the casing tong to hang off-center, thereby avoiding interference between the gripper head of the lifting tool and the tubular being handled. In some embodiments, the handling tool includes at its lower end a triangular-shaped section that has the casing tong connection. To prevent the handling tool from tilting, a guide head of a lower guide arm of the vertical pipe handler may be used. A computer control system may be used to send one or more commands to the vertical pipe handler to place the casing tong in a correct position to connect two vertically oriented tubulars and, after connection, to move the casing tong out of the way as the vertical pipe handler presents a new tubular for connection.

BRIEF DESCRIPTION OF THE DRAWINGS

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

ELEMENTS AND NUMBERING USED IN THE DRAWINGS

Figure 1:
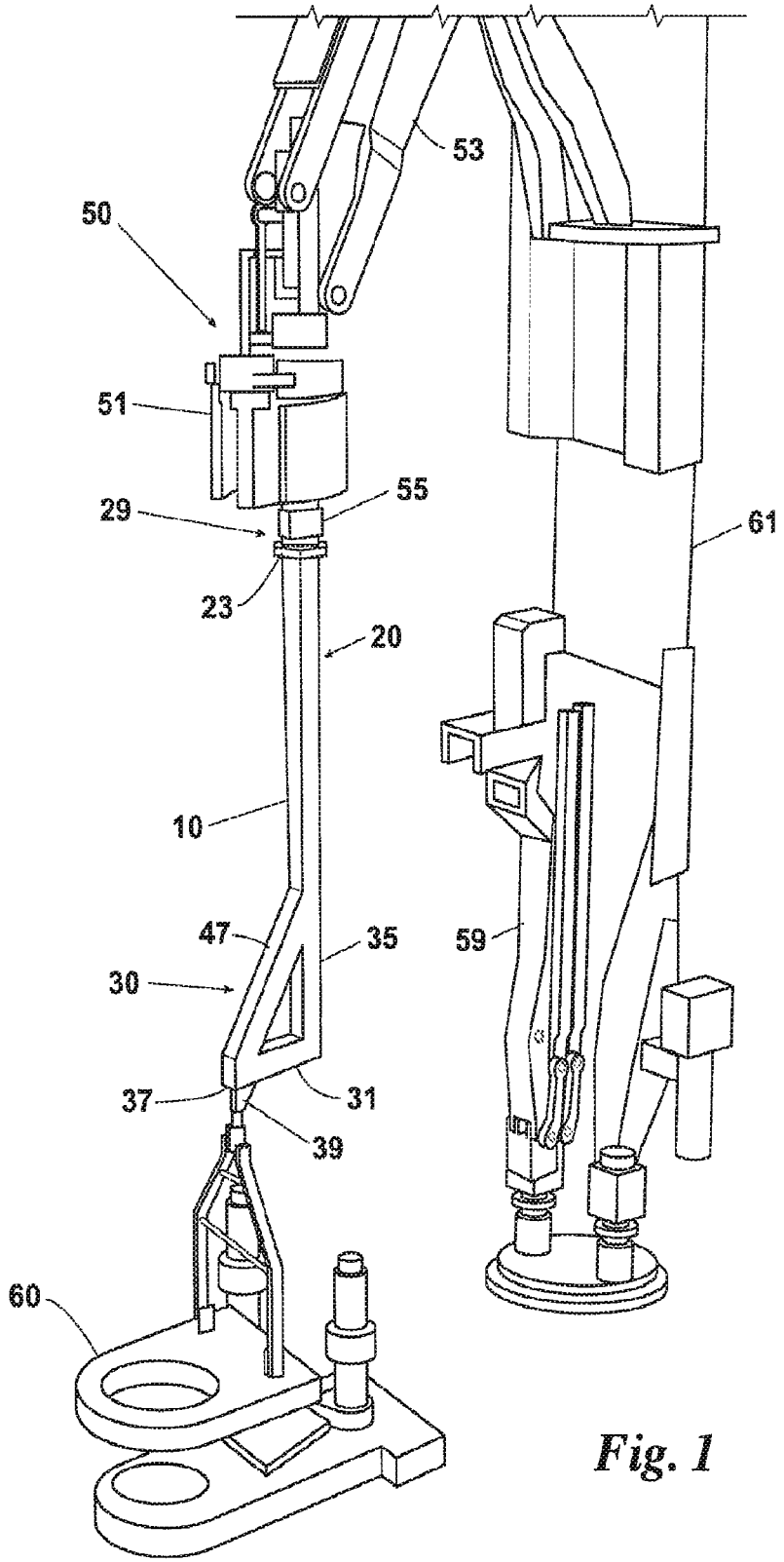
FIG. 1 is a view of an embodiment of a handle tool for casing tongs when connected to the gripper head of a vertical pipe handler.

10 Handle tool or casing tong handling tool
20 First section
21 Lower end
23 Upper end
25 Vertical centerline
29 Lifting tool connection
30 Second section
31 Horizontal leg
33 Casing tong connection
35 Vertical leg
37 Far end
39 Flange
41 Connection means
45 Vertical centerline
47 Angled leg
50 Vertical pipe handler
51 Gripper head
53 First arm
55 Lifting tool
57 Guide head
59 Second arm
60 Casing tong
61 Column

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of a handle tool for casing tongs of this disclosure are mounted to a lifting tool of a vertical pipe handling system. The vertical pipe handling system may include a vertical racker column in communication with one or more arms. The lifting tool may be a heavy lifting tool connected to one of the arms and include a gripper head for handling tubulars T. The handle tool provides a casing tong connection point that may be offset in a horizontal direction from where the handling tool connects to the lifting tool. The amount of offset can be an amount effective to prevent a clash or interference between the gripper head of the lifting tool and a tubular T being handled by the casing tong. The connection of the handle tool to the lifting tool may be any type of connection suitable for safely securing the handle tool to the lifting tool or gripper head.

The vertical pipe handler may perform all vertical pipe handling operations on the drill floor, including racking stands, building stands in the mousehole, picking up singles from the catwalk, laying out singles to the catwalk, and tripping in and out of the fingerboard. These functions may be fully automated with a robotic control system that controls and monitors all operations and protects the column and rig from operator failure. In embodiments, the control system may include software to execute a casing tong mode in connection with the handling tool of this disclosure. This control system sends commands and receives feedback from an arm of the vertical handler which is connected to the casing tong handling tool and may send commands and receive feedback from a casing tong connected to the handling tool.

Figure 2:
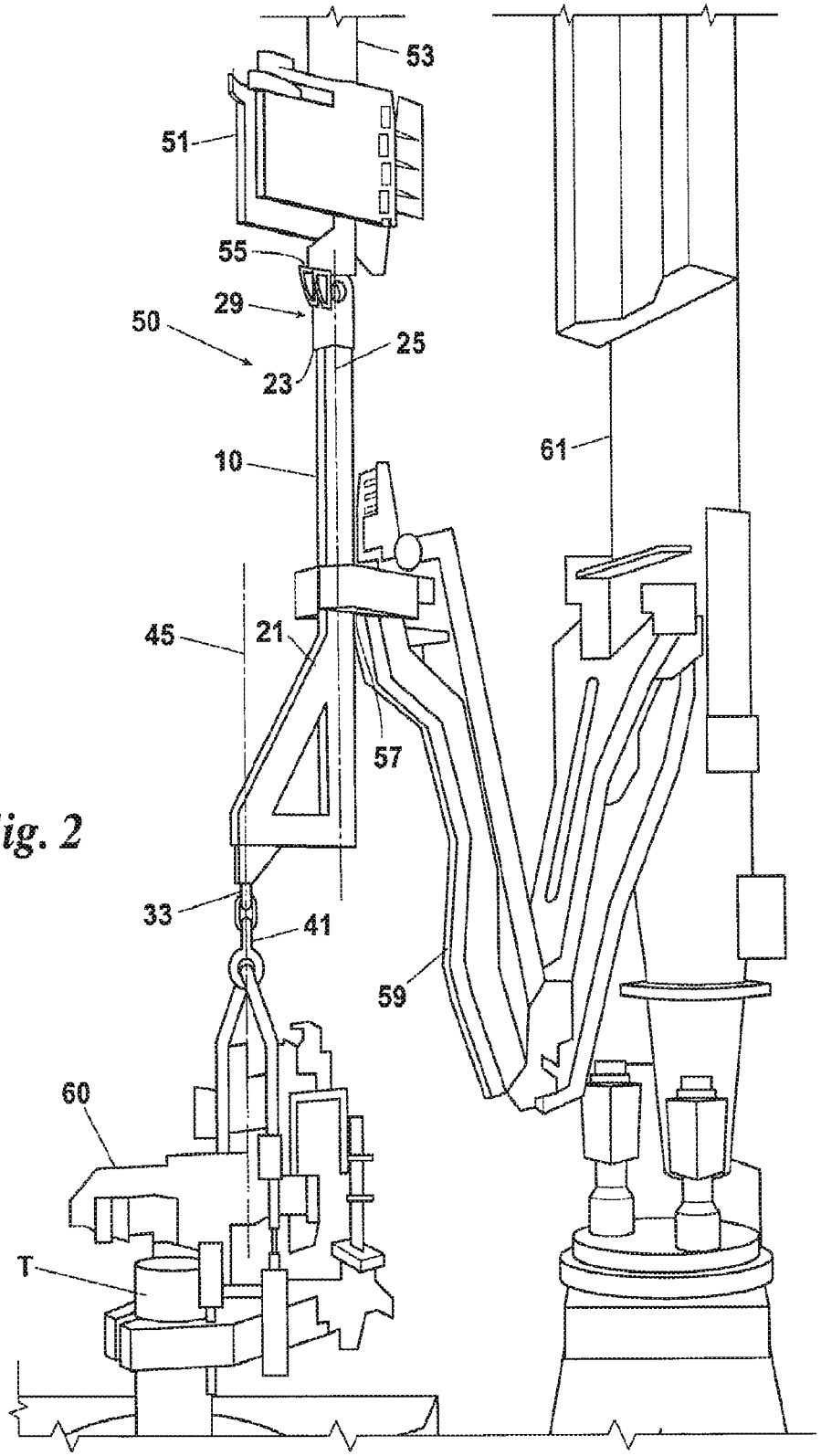
FIG. 2 is view of an embodiment of the handle tool when gripped by the guide head connected to a lower guide arm of a vertical pipe handler.

Referring now to FIGS. 1 & 2, embodiments of vertical pipe handling system or vertical pipe handler 50 include a lifting tool 55 with a gripper head 51 and a casing tong handling tool 10 connected to the lifting tool 55. The lifting tool 55 is connected to a first arm 53 of the handler 50. The arm 50 may be an upper arm moveable in the X-, Y-, and Z-planes. The lifting tool 55 or arm 53 also may provide for rotation of the gripper head 55 in a horizontal plane. The handler 50 may include a column 61 to which the arm 53 is connected.

The connection 29 to the lifting tool 55 is one suitable for connecting the tool 10 to the lifting tool 55. In some embodiments, the lifting tool connection 29 may be located below the gripper head 51. In other embodiments, the lifting tool connection 29 may be located on the gripper head 51. The gripper head 51 may also be used as the connection 29 and grip the handling tool 10.

The casing tong handling tool 10 may include a first section 20 that is connected to the lifting tool 55 and a second section 30 that provides a casing tong connection 33 that is offset in a horizontal direction from this connection 29 to the lifting tool 55. The casing tong connection 33 may include a flange 39 that receives means 41 such as a hook for connecting the casing tong 60 to the flange 39.

When the casing tong connection 33 is offset from the lifting tool connection 29, the casing tong 60 hangs off-center relative to the tool 10. The amount of offset—for example, as measured by the horizontal distance between a vertical centerline 45 of the casing tong connection 33 and a vertical centerline 25 of the lifting tool connection 29—may be an amount effective to prevent a clash or interference between a tubular T being handled by the casing tong 60 and the gripper head 51. With this amount of offset, the tubular T can extend well above the casing tong 60 without interfering with the gripper head 51. To prevent the casing tong handling tool 10 from tilting, a second arm 59 of the handler 50 can be used. The arm 59, which may be a lower arm relative to arm 53 and moveable in the X-, Y-, and Z-planes, can include a guide head 57 that receives the tool 10 and keeps it in a correct vertical orientation.

The sections 20, 30 of the handling tool 10 may be square-shaped in cross-section or pipe- or tubular-shaped in cross-section and may differ from one another in cross-section. In some embodiments, the first section 20 of the handling tool 10 may be include an elongated straight section located toward an upper end 23 of the tool 10. In other embodiments, the first section may be curved, at least in part. The upper end 23 may be mounted in the lifting tool 55, below the gripper head 51. Or, the upper end 23 may connect to, or be received by, the gripper head 51.

The second section 30 of the handling tool may include a non-vertical leg 31 or 47 that extends away from the lifting tool connection 29 and toward the casing tong connection 33. Arranged in this way, the leg 31, 47 provides the horizontal offset of the casing tong connection 33. The connection 33 may be located at the far end 37 of the leg 31, 47. In some embodiments, the leg 31 is a horizontal leg. In other embodiments, the leg 47 is an (oblique) angled leg. The second section 30 may use legs 31 and 47 in combination with a vertical leg 35 and form a triangular-shape. In some embodiments, the legs 31, 35, 47 form a right angle. The vertical leg 35 may be arranged coaxial to the first section 20.

Embodiments of a method for controlling a casing tong 60 on a drill floor include using a microprocessor and associated software to send one or more commands to a first arm 53 of a vertical pipe handler 50 that is connected to a lifting tool 55. The lifting tool includes a gripper head 51 for handling tubulars T and a casing tong handling tool 10 supporting the casing tong 60. The one or more commands place the casing tong 60 in proper position to connect two vertically oriented tubulars T together. After connection of the two tubulars, one or more commands may be sent to the arm 53 to move the casing tong 60 away from this connect-to position. The microprocessor and associated software may also send one or more commands to second arm 59 and its guide head 57 to help the tool 10 maintain a vertical orientation and prevent the tool 10 from tilting.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A pipe handler comprising:

a lifting tool including a gripper head;

a casing tong handling tool;

a first connector configured to connect the lifting tool to the casing tong handling tool, wherein the first connector has a first vertical centerline extending therethrough;

a casing tong configured to handle a tubular; and a second connector located toward a lower end of the casing tong handling tool, wherein the second connector is configured to connect the casing tong handling tool to the casing tong, wherein the second connector has a second vertical centerline extending therethrough, and wherein the first vertical centerline being offset in a horizontal direction from the second vertical centerline, which prevents the tubular being handled by the casing tong from contacting the gripper head.

2. A pipe handler according to claim 1 further comprising a first arm located above, and connected to, the lifting tool.

3. A pipe handler according to claim 1 further comprising a second arm including a head, the second arm coupled to and located to a side of the lifting tool.

4. A pipe handler according to claim 3 wherein the second arm is horizontally offset from the lifting tool.

5. A pipe handler according to claim 1 further comprising a lifting tool connection being located on the gripper head.

6. A pipe handler according to claim 1 further comprising a lifting tool connection being located below the gripper head.

7. A pipe handler according to claim 1 further comprising the lower end of the casing tong handling tool including at least one non-vertical leg, a casing tong connection being located toward one end of the at least one non-vertical leg.

8. A pipe handler according to claim 1 wherein the first connector comprises a lifting tool connection that is configured to connect the lifting tool to the casing tong handling tool.

9. A pipe handler according to claim 1 wherein the second connector comprises a casing tong connection that is configured to connect the casing tong handling tool to the casing tong.

10. A pipe handler comprising:

a casing tong configured to handle a tubular;

a casing tong handling tool connected at one end to a lifting tool via a first connection, wherein the lifting tool comprises a gripper head, and wherein the first connection has a first vertical centerline extending therethrough; and a casing tong connection located toward a lower end of the casing tong handling tool, wherein the casing tong connection has a second vertical centerline extending therethrough;

wherein the first vertical centerline is offset in a horizontal direction from the second vertical centerline;

wherein the offset prevents the tubular from contacting the gripper head.

11. A pipe handler according to claim 10 further comprising a first arm located above, and connected to, the lifting tool.

12. A pipe handler according to claim 10 further comprising a second arm including a head, the second arm coupled to and located to a side of the lifting tool.

13. A vertical pipe handler according to claim 10 further comprising a connection of the casing tong handling tool to the lifting tool being located on the gripper head.

14. A pipe handler according to claim 10 further comprising a connection of the casing tong handling tool to the lifting tool being located below the gripper head.

15. A pipe handler according to claim 10 further comprising the lower end of the casing tong handling tool including at least one non-vertical leg, the casing tong connection being located toward one end of the at least one non-vertical leg.

16. A method for controlling a casing tong on a drill floor, the method being executed by a microprocessor with associated software, the method comprising:

sending one or more commands to an arm of a pipe handler that is connected to a lifting tool, the lifting tool including a gripper head that is connected to a casing tong handling tool via a first connection, the casing tong being connected to the casing tong handling tool via a second connection, wherein the first connection has a first vertical centerline extending therethrough, wherein the second connection has a second vertical centerline extending therethrough, and wherein the first vertical centerline is offset in a horizontal direction from the second vertical centerline;

wherein the one or more commands places the casing tong in a position to connect a first, upper tubular to a second, lower tubular or, after connection of the first and second tubulars, moves the casing tong away from the position, and further wherein the offset prevents the first tubular being connected from contacting the gripper head.

* * * * *